US007398820B2

(12) United States Patent
Inaba

(10) Patent No.: US 7,398,820 B2
(45) Date of Patent: Jul. 15, 2008

(54) EVAPORATOR

(75) Inventor: Hiroyuki Inaba, Saitama (JP)

(73) Assignee: Calsonic Kansei Corporation, Tokyo (JP)

( * ) Notice: Subject to any disclaimer, the term of this patent is extended or adjusted under 35 U.S.C. 154(b) by 268 days.

(21) Appl. No.: 11/362,161

(22) Filed: Feb. 27, 2006

(65) Prior Publication Data

US 2006/0191673 A1 Aug. 31, 2006

(30) Foreign Application Priority Data

Feb. 28, 2005 (JP) ..... 2005-054962

(51) Int. Cl.
*F28D 1/02* (2006.01)
*F28F 9/02* (2006.01)
*F25B 39/02* (2006.01)

(52) U.S. Cl. ..... 165/153; 165/174

(58) Field of Classification Search ..... 165/152, 165/153, 174, 175, 176; 62/515, 519, 524, 62/526

See application file for complete search history.

(56) References Cited

U.S. PATENT DOCUMENTS 6,272,881 B1 * 8/2001 Kuroyanagi et al. ..... 62/525
6,449,979 B1 * 9/2002 Nagasawa et al. ..... 62/503
6,640,568 B2 * 11/2003 Shirota et al. ..... 62/216
6,814,135 B2 * 11/2004 Narahara et al. ..... 165/153
7,040,385 B2 * 5/2006 Higashiyama ..... 165/153
7,107,787 B2 * 9/2006 Inaba ..... 62/515
7,219,511 B2 * 5/2007 Inaba et al. ..... 62/515
2001/0027860 A1 * 10/2001 Watanabe ..... 165/178

FOREIGN PATENT DOCUMENTS

JP 06-074679 A 3/1994
JP 10-238896 A 9/1998
JP 2000-105091 A 4/2000

* cited by examiner

*Primary Examiner*—Tho V Duong
(74) *Attorney, Agent, or Firm*—Foley & Lardner LLP

(57) ABSTRACT

An evaporator includes a first heat exchanger and a second heat exchanger. The first heat exchanger includes a first path in which coolant flows downwardly, a second path in which the coolant from the first path flows upwardly, and a third path in which the coolant from the second path flows downwardly. The second heat exchanger includes at least two paths including a first path in which the coolant from the first heat exchanger flows upwardly. The number of tubes in the first path of the first heat exchanger is smaller than that in any one of the other paths of the exchangers. The number of tubes in the second path of the first heat exchanger is equal to or greater than that in the third path of the first heat exchanger. The number of tubes in the first path of the second heat exchanger is smaller than that in the third path of the first heat exchanger.

5 Claims, 11 Drawing Sheets

EVAPORATOR

CROSS REFERENCE TO RELATED APPLICATIONS AND INCORPORATION BY REFERENCE

This application is based upon and claims the benefit of priority from the prior Japanese Patent Application No. 2005-054962 filed on 28Feb. 2005; the entire contents of which are incorporated herein by reference.

BACKGROUND OF THE INVENTION

1. Field of the Invention

The present invention relates to an evaporator having two heat exchangers arranged face-to-face in an air flow direction.

2. Description of Related Art

Examples of an evaporator having two heat exchangers arranged on the windward and leeward sides of an air flow, respectively, are disclosed in, for example, Japanese Unexamined Patent Application Publications No. Hei-6-74679, No. Hei-10-238896, and No. 2000-105091. Each of the heat exchanges in either example has an upper tank, a lower tank, and tubes that connect the upper and lower tanks to each other and communicate therewith. Each heat exchanger is sectioned into paths each involving a group of the tubes. In the evaporator, the two heat exchangers complementary cool air to reduce unevenness in a temperature distribution to a grater extent than an evaporator having a single heat exchanger.

SUMMARY OF THE INVENTION

Even with such a configuration as described above, the related arts are unable to completely eliminate an uneven temperature distribution. The uneven temperature distribution occurs when a region where a liquid coolant does not pass, i.e., where a gaseous coolant passes.

An object of the present invention is to provide an evaporator having two heat exchangers arranged face-to-face in an air flow direction. The evaporator is capable of effectively minimizing an uneven temperature distribution, in particular, when coolant is circulated at a low flow rate.

To accomplish the object, the inventor of the present invention conducted tests and found coolant distribution characteristics that appear in vertically upward and downward coolant paths when liquid coolant is introduced into the paths at a low flow rate. The characteristics are:

a high-density coolant, i.e., a liquid coolant passing through an upward path at a low flow rate is relatively evenly distributed through the upward path as shown in FIGS. 11 and 12; and a high-density coolant, i.e., a liquid coolant passing through a downward path at a low flow rate mostly flows downwardly from a proximal side of an upper tank, and therefore, substantially no coolant flows downwardly from a distal side of the upper tank as shown in FIG. 11. As the density of the coolant decreases so as to increase the flow rate thereof, the coolant approaches the distal side of the upper tank, to gradually solve the uneven distribution in the downward path as shown in FIG. 12.

FIGS. 11 and 12 show the distribution of coolant in the tests carried out by the inventor. In each test, a coolant at a low flow rate passed through a heat exchanger. In FIG. 11, the heat exchanger 700 includes a downward first path 710 and an upward second path 720 through which a liquid coolant is passed at a low flow rate. In FIG. 12, the heat exchanger 800 includes an upward first path 810 and a downward second path 820 through which a liquid coolant is passed at a low flow rate.

In FIG. 11, the liquid coolant is introduced at a low flow rate into the heat exchanger 700. The coolant has a high density in the downward first path 710, and therefore, mostly flows downwardly from a proximal side (left side in FIG. 11) of an upper tank 711. Substantially no coolant flows downwardly from a distal side (right side in FIG. 11) of the upper tank 711. The liquid coolant unevenly passes through the first path 710, and therefore, little heat exchange is carried out in the first path 710 so that the coolant, maintaining a high density, enters the second path 720. The liquid coolant substantially fills the upward second path 720 and substantially uniformly passes therethrough.

In FIG. 12, the liquid coolant is introduced at a low flow rate into the heat exchanger 800. The coolant has a high density in the upward first path 810, and therefore, uniformly passes therethrough. Due to heat exchange carried out in the first path 810, the density of the coolant decreases and the flow rate thereof increases when the coolant enters and passes through the downward second path 820. The coolant reaches a distal side (right side in FIG. 12) of an upper tank 811, and therefore, the distribution of the coolant in the downward path 820 is better than that in the downward path 710 of FIG. 11. If the flow rate of the coolant is relatively low and the density thereof is high in the downward path 820, the coolant distribution (temperature distribution) in the downward path 820 will not be so good.

After the tests, an evaporator was invented that is capable of minimizing an uneven temperature distribution particularly when a liquid coolant is introduced at a low flow rate into the evaporator.

An aspect of the present invention provides an evaporator having a first heat exchanger and a second heat exchanger overlapping the first heat exchanger in an air flow direction. The first heat exchanger has an upper tank, a lower tank, tubes extending vertically and arranged side by side in a longitudinal direction of the upper and lower tanks, and configured to connect the upper and lower tanks to each other and communicate with the upper and lower tanks, a coolant inlet provided for the upper tank at a first end of the evaporator, a coolant outlet provided for the lower tank at a second end of the evaporator, and partitions arranged inside the upper and lower tanks, configured to divide the inside of the first heat exchanger into a first path in which coolant that has entered through the coolant inlet flows downwardly, a second path that is downstream from the first path and through which the coolant flows downwardly from the first path, and a third path that is downstream from the second path and through which the coolant flows downwardly from the second path. The second heat exchanger has an upper tank, a lower tank, tubes extending vertically and arranged side by side in a longitudinal direction of the upper and lower tanks and configured to connect the upper and lower tanks to each other and communicate with the upper and lower tanks, a coolant inlet provided for the lower tank at the second end of the evaporator and configured to introduce the coolant from the coolant outlet of the first heat exchanger into the second heat exchanger, a coolant outlet arranged at the first end of the evaporator, and partitions arranged inside the lower tank, configured to divide the inside of the second heat exchanger into at least two paths including a first path in which the coolant that entered through the coolant inlet flows downwardly. The number of tubes in the first path of the first heat exchanger is smaller than that in any one of the other paths of the first and second heat exchangers. The number of tubes in the second path of the first heat exchanger is equal to or greater than that in the third path of the first heat exchanger. The number of tubes in the first path of the second heat exchanger is smaller than that in the third path of the first heat exchanger.

Another aspect of the present invention provides an evaporator having a first heat exchanger and a second heat exchanger overlapping the first heat exchanger in an air flow direction. The first heat exchanger has an upper tank, a lower tank, tubes extending vertically and arranged side by side in a longitudinal direction of the upper and lower tanks and configured to connect the upper and lower tanks to each other and communicate with the upper and lower tanks, a coolant inlet provided for the lower tank at a first end of the evaporator, a coolant outlet provided for the lower tank at a second end of the evaporator, and a partition arranged inside the lower tank, configured to divide the inside of the first heat exchanger into a first path in which coolant that entered through the coolant inlet flows upwardly and a second path that is downstream from the first path and in which the coolant from the first path flows downwardly. The second heat exchanger has an upper tank, a lower tank, tubes extending vertically and arranged side by side in a longitudinal direction of the upper and lower tanks and configured to connect the upper and lower tanks to each other and communicate with the upper and lower tanks, a coolant inlet provided for the lower tank at the second end of the evaporator and configured to introduce the coolant from the coolant outlet of the first heat exchanger into the second heat exchanger, a coolant outlet arranged at the first end of the evaporator, and partitions arranged inside the lower tank and configured to divide the inside of the second heat exchanger into at least two paths including a first path in which the coolant that entered through the coolant inlet flows upwardly. The number of tubes in the first path of the first heat exchanger is equal to or greater than that in the second path of the first heat exchanger. The number of tubes in the first path of the second heat exchanger is smaller than that in the second path of the first heat exchanger.

DETAILED DESCRIPTION OF EMBODIMENTS

Evaporators according to embodiments of the present invention will be explained with reference to the drawings.

First Embodiment

An evaporator according to the first embodiment of the present invention will be explained with reference to FIGS. 1 to 7B.

The evaporator 1 according to the first embodiment is arranged in a refrigeration cycle of an air conditioner for a vehicle. The evaporator 1 is accommodated in an air conditioner installed in the vehicle, to cool air passing through the air conditioner. More precisely, the evaporator 1 carries out heat exchange between coolant flowing inside the evaporator 1 and air flowing outside the evaporator 1, to thereby cool the air. The coolant flowing inside the evaporator 1 takes heat from the air flowing outside the evaporator 1 and evaporates.

The evaporator of the present invention is applicable not only to an air conditioner for a vehicle but also to other equipment.

The structure of the evaporator 1 will be roughly explained.

Figure 6:
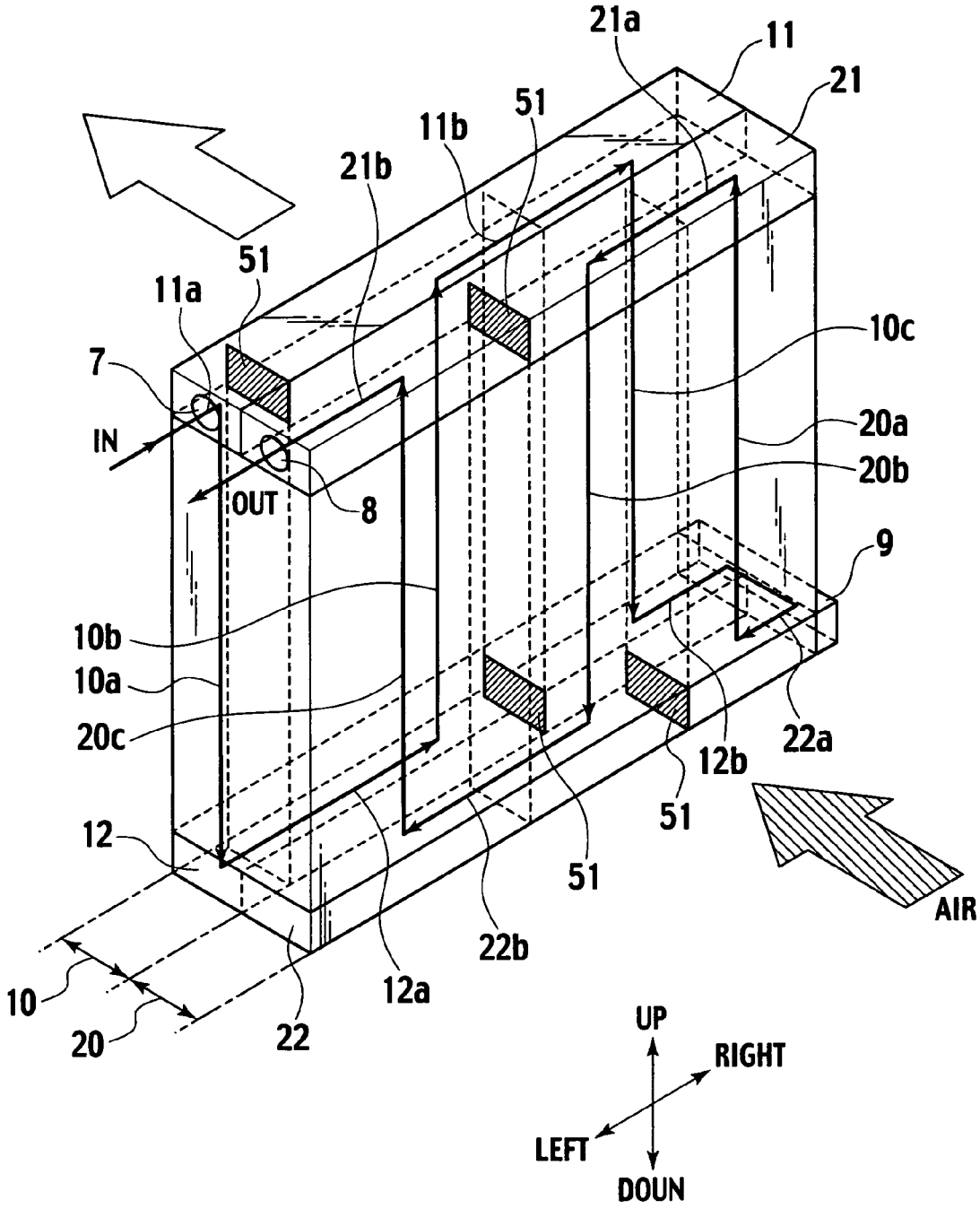
FIG. 6 is a view schematically showing flows of coolant in the evaporator.
Figure 7A:
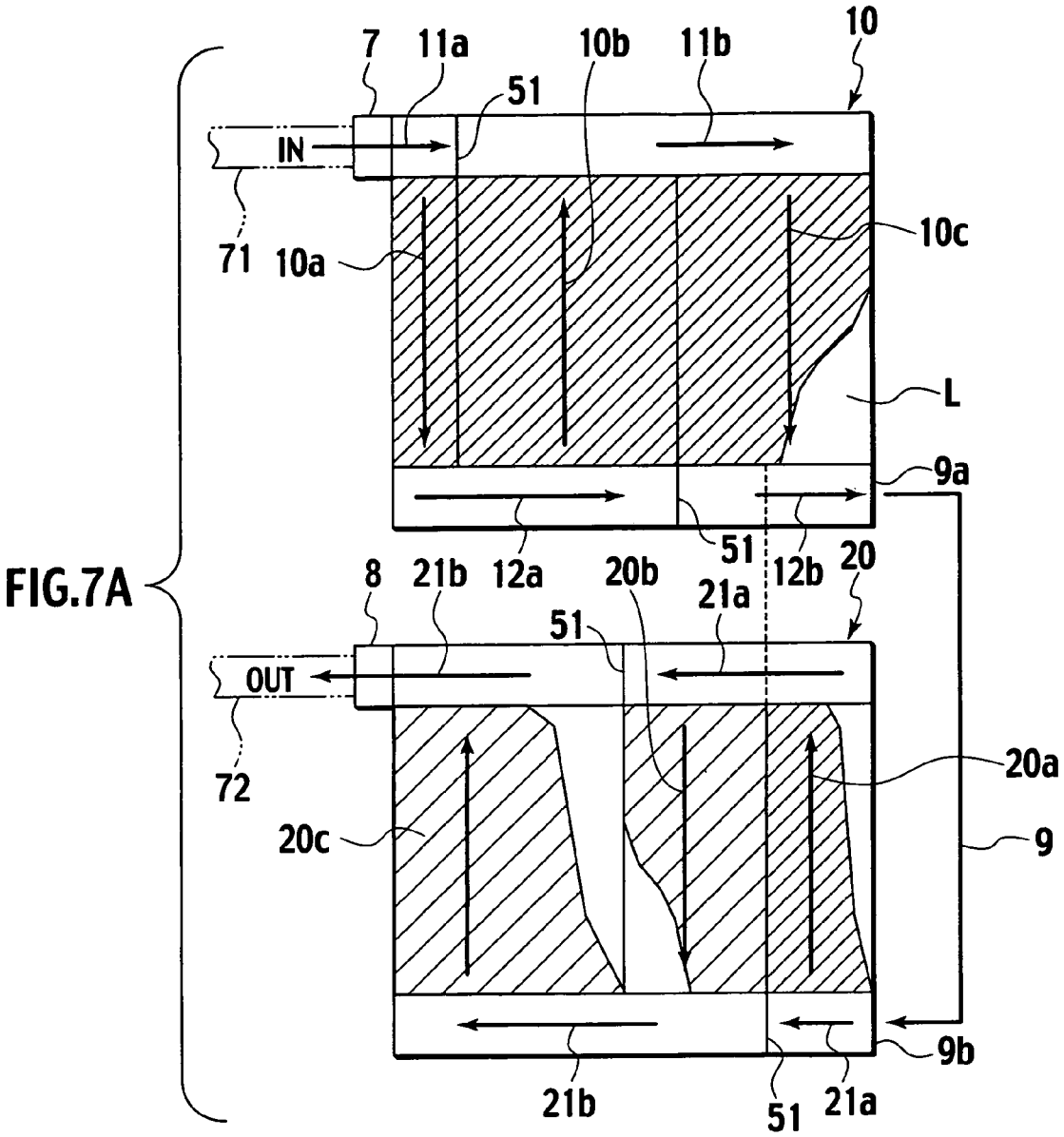
FIGS. 7A and 7B are views schematically showing distributions of liquid coolant in the evaporator.
Figure 7B:
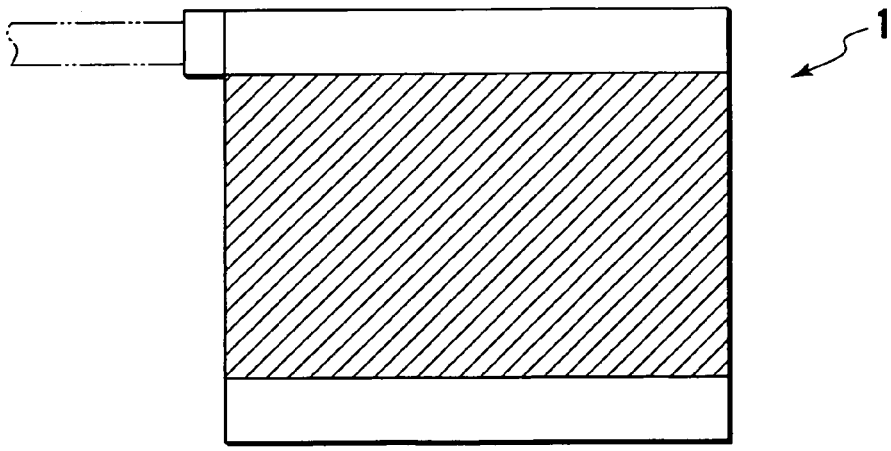

In FIGS. 6, 7A, and 7B, the evaporator 1 has a first heat exchanger 10 and a second heat exchanger 20 that are arranged face-to-face in an air flow direction.

The first heat exchanger 10 is on an inlet side of the coolant flow, and the second heat exchanger 20 is on an outlet side of the coolant flow. The coolant is first introduced to the first heat exchanger 10, and passed through and discharged from the first heat exchanger 10. The coolant that is discharged from heat exchanger 10 Is introduced into the second heat exchanger 20 and passed through and discharged from the second heat exchanger 20.

The first heat exchanger 10 has an upper tank 11, a lower tank 12, and tubes 30 (FIGS. 1 and 3) that connect the tanks 11 and 12 to each other to communicate therewith. Each tube 30 incorporates a heat exchange passage 31 for passing coolant therethrough.

The second heat exchanger 20 has an upper tank 21, a lower tank 22, and tubes 30 (FIGS. 1 and 3) that connect the tanks 21 and 22 to each other to communicate therewith. Each tube 30 incorporates a heat exchange passage 31 (FIG. 3) for passing coolant therethrough.

In the first heat exchanger 10, the tubes 30 are grouped into a first path 10*a*, a second path 10*b*, and a third path 10*c*, from the left to the right of the first heat exchanger 10 as viewed in the drawings. A left end of the upper tank 11 is provided with a coolant inlet (evaporator inlet) 7. The upper tank 11 is partitioned by a partition 51 into a first upper tank section 11*a* and a second upper tank section 11*b*. The lower tank 12 is partitioned by a partition 51 into a first lower tank section 12*a* and a second lower tank section 12*b*. A right end (as shown in the drawings) of the lower tank 12 is provided with a coolant outlet 9*a*. Consequently, the tubes 30 of the first heat exchanger 10 are grouped into the first path 10*a*, second path 10*b*, and third path 10*c* from the left to the right (as shown in the drawings) of the first heat exchanger 10.

Coolant is introduced through the coolant inlet 7 into the first heat exchanger 10, is passed through the first upper tank section 11*a*, first path 10*a*, first lower tank section 12*a*, second path 10*b*, second upper tank section 11*b*, third path 10*c*, and second lower tank section 12*b*, and is discharged from the coolant outlet 9*a* of the first heat exchanger 10. The discharged coolant is passed through a connection 9 into a coolant inlet 9*b* of the second heat exchanger 20.

In the second heat exchanger 20, the tubes 30 are grouped into a first path 20*a*, a second path 20*b*, and a third path 20*c* from the right to the left (as shown in the drawings) of the second heat exchanger 20. A right end (as shown in the drawings) of the lower tank 22 is provided with the coolant inlet 9*b*. The lower tank 22 is partitioned by a partition 51 into a first lower tank section 22*a* and a second lower tank section 22*b*. The upper tank 21 is partitioned by a partition 51 into a first upper tank section 21*a* and a second upper tank section 21*b*. A left end (as shown in the drawings) of the upper tank 21 is provided with a coolant outlet (evaporator outlet) 8 of the second heat exchanger 20. Consequently, the tubes 30 of the second heat exchanger 20 are grouped into the first path 20*a*, second path 20*b*, and third path 20*c* from the right to the left of the second heat exchanger 20.

The coolant introduced through the coolant inlet 9*b* into the second heat exchanger 20 is passed through the first lower tank section 22*a*, first path 20*a*, first upper tank section 21*a*, second path 20*b*, second lower tank section 22*b*, third path 20*c*, and second upper tank section 21*b* and is discharged from the evaporator outlet 8 of the evaporator 1.

The structure of the evaporator 1 will be further explained with reference to FIGS. 1 to 5. The evaporator 1 has the tubes 30 alternated with outer fins 33 in a horizontal direction, to form a multilayer structure. The tubes 30 and outer fins 33 both extend in a vertical direction. The outermost parts of the multilayer structure in an X-direction are provided with reinforcing side plates 35 and 37 and a pipe connector 36. These parts and tubes are welded together to form the evaporator 1 as shown in FIGS. 1 to 4B.

Figure 1:
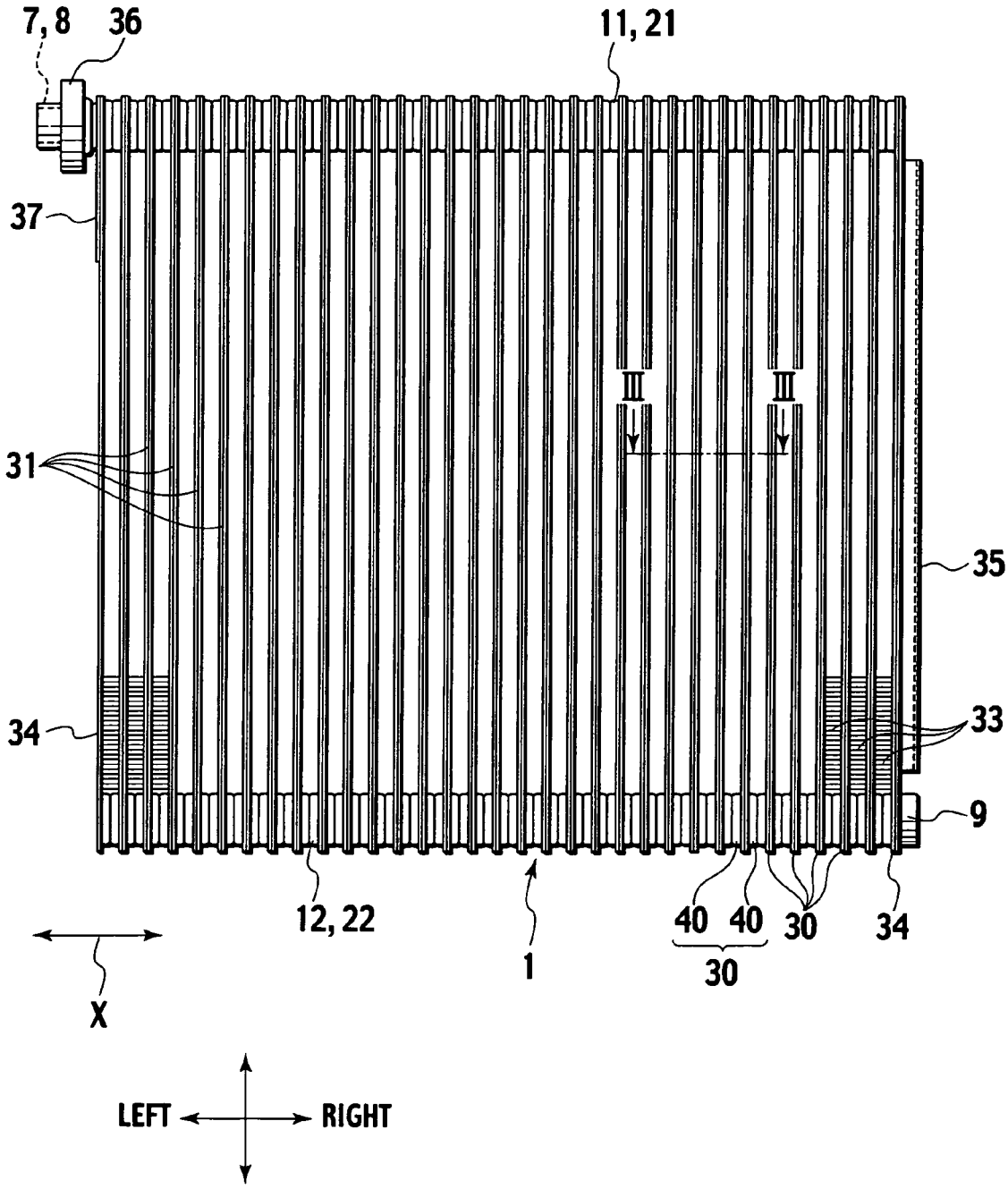
FIG. 1 is a front view of an evaporator seen from a windward side, according to a first embodiment of the present invention.
Figure 2:
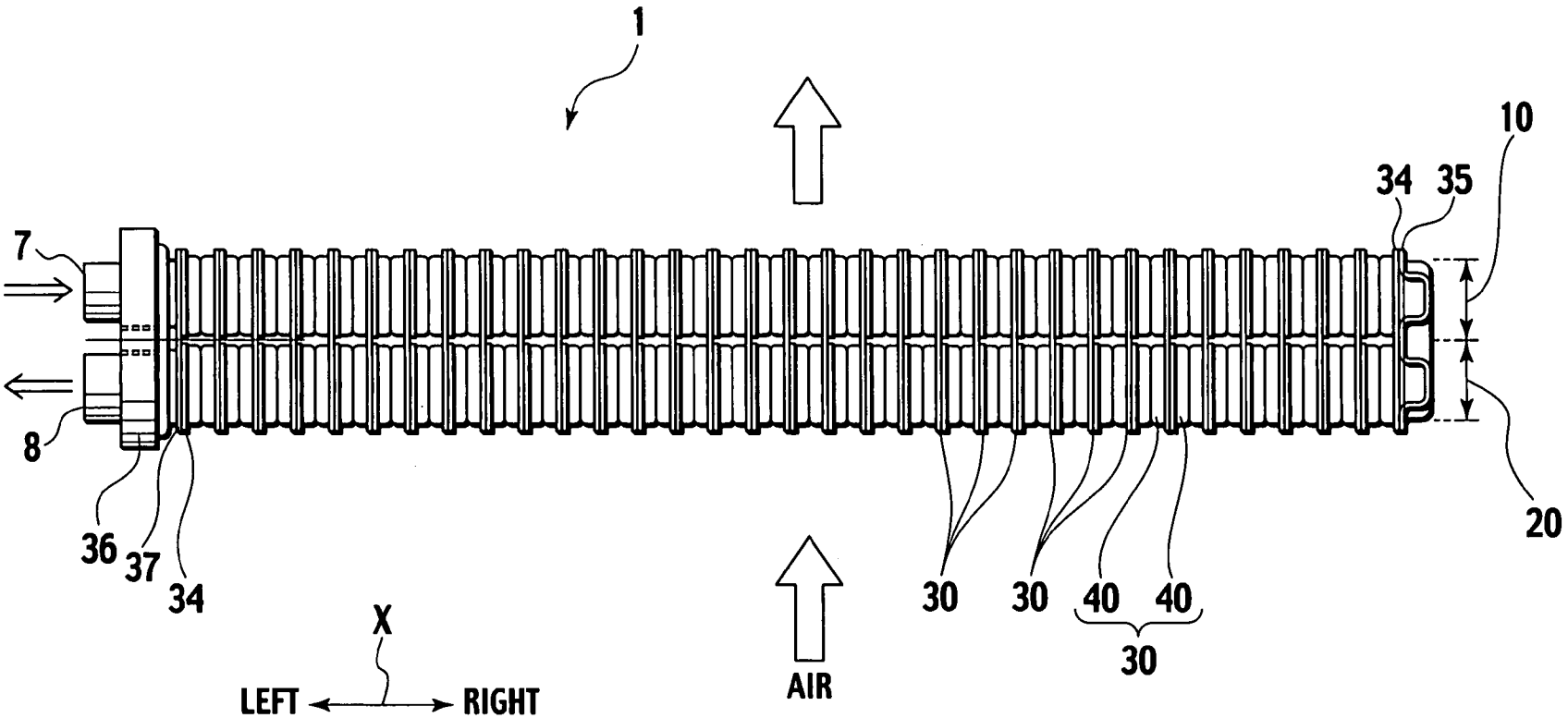
FIG. 2 is a top view of the evaporator of FIG. 1.
Figure 3:
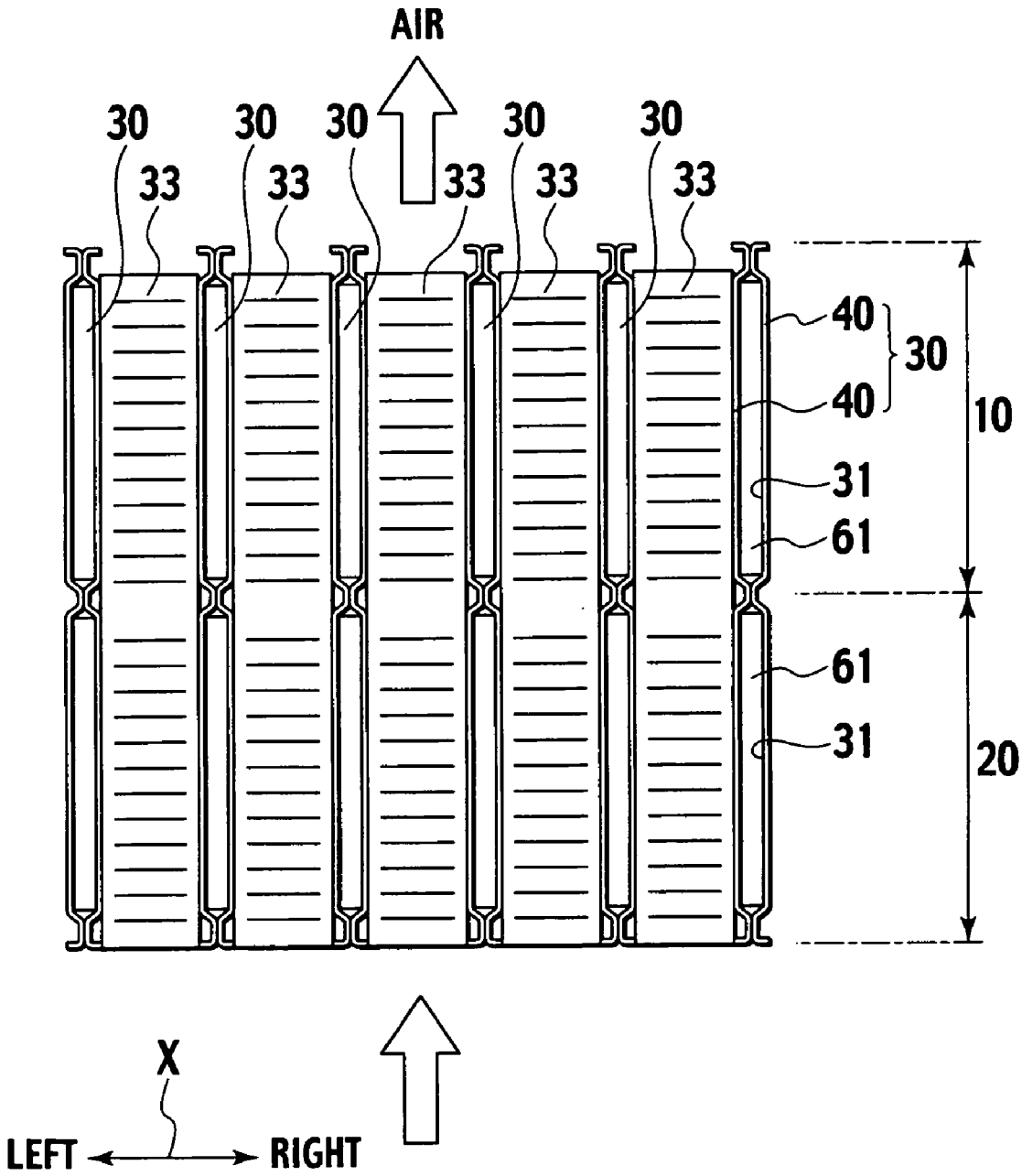
FIG. 3 is a sectional view along a line III-III of FIG. 1.
Figure 4A:
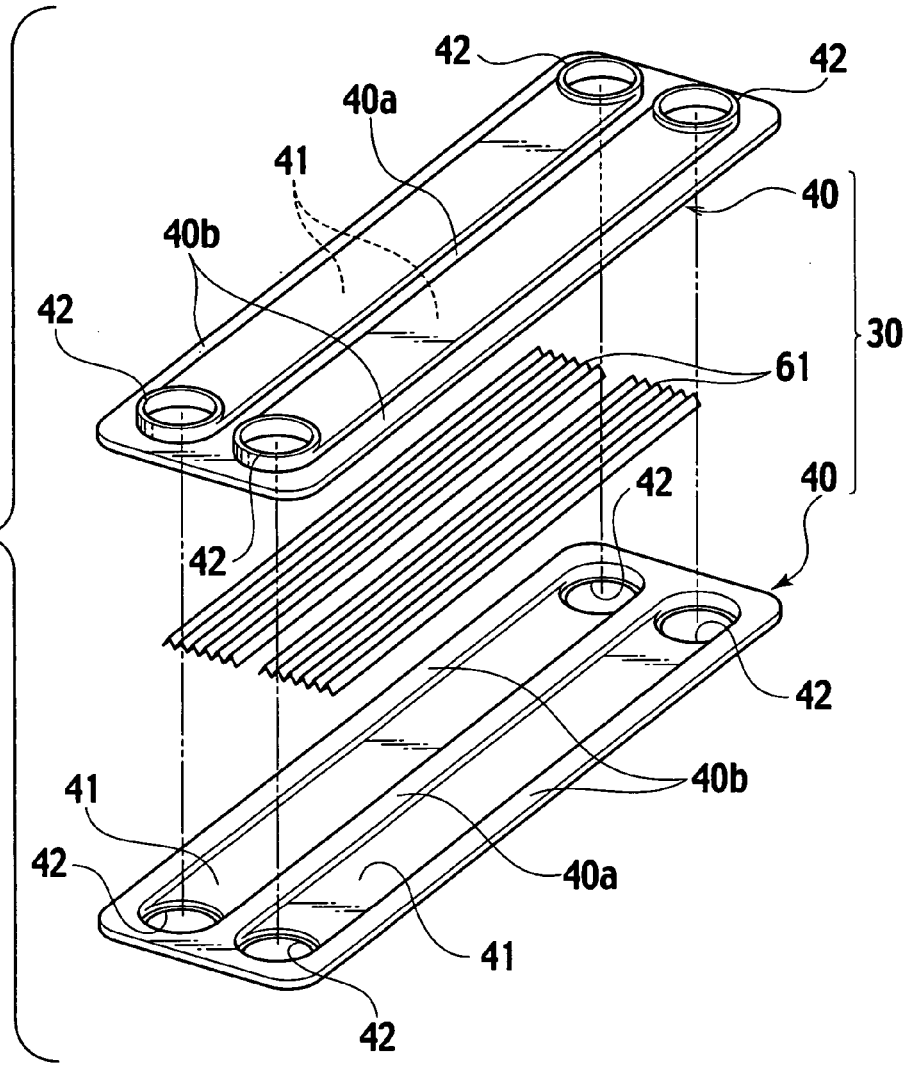
FIG. 4A is a perspective view of a pair of thin metal plates and inner fins that form a tube of the evaporator.
Figure 4B:
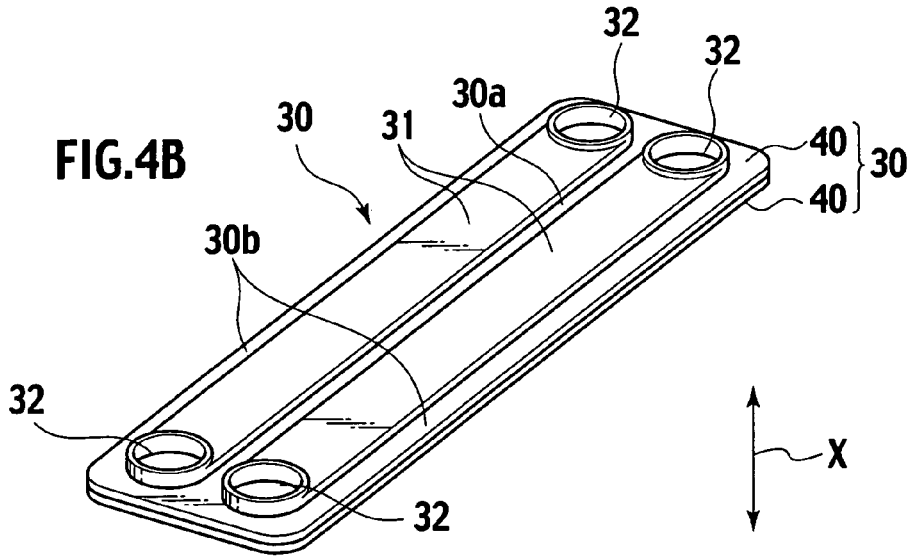
FIG. 4B is a perspective view of the tube of the evaporator.

The tube 30 are formed by sandwiching inner fins 61 between a pair of thin metal plates 40 as shown in FIGS. 4A and 4B. Each thin metal plate 40 has two heat exchange recesses 41 on each side of a center partition 40*a* and four cylindrical partial tanks 42 protruding in the X-direction on axial ends of the heat exchange recesses 41.

The thin metal plates 40 are joined together by joining peripheral flanges 40*b* and center flanges 40*a* together to form the tube 30. In connection with this, the tube 30 has two heat exchange passages 31 on each side of a center partition 30*a* and four partial tanks 32 communicating with the heat exchange passage 31 on the axial ends thereof.

Figure 5:
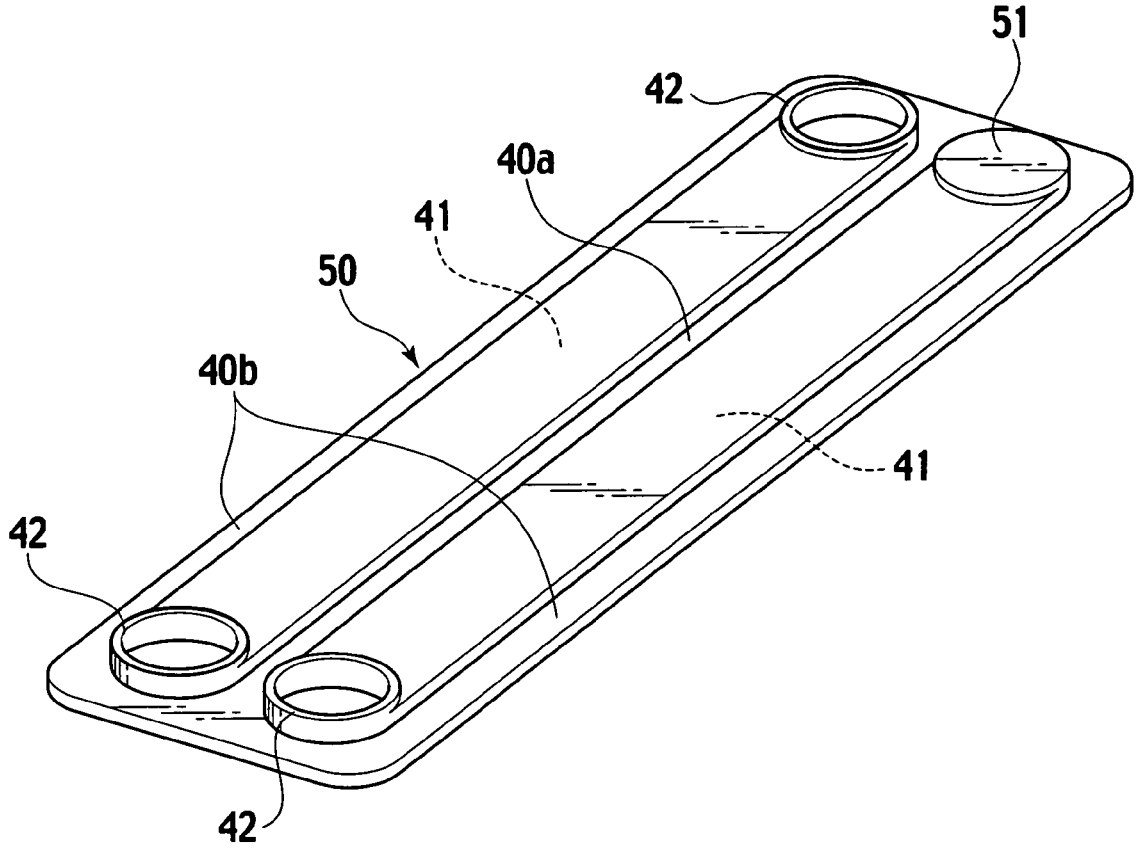
FIG. 5 is a perspective view of a thin metal plate provided with a tank partition.

At a predetermined location in the evaporator 1, there is a thin metal plate 50 in place of the thin metal plate 40. The thin metal plate 50 is provided with a partition 51 as shown in FIG. 5. With the thin metal plates 50, the tanks 11, 12, 21, and 22 are divided into sections, and the heat exchangers 10 and 20 are divided into paths as shown FIG. 6.

The paths of the evaporator 1 will be explained with reference to FIGS. 6, 7A, and 7B.

In the evaporator 1 according to the first embodiment, the first heat exchanger 10 has the three paths 10*a*, 10*b*, and 10*c* and the second heat exchanger 20 has the three paths 20*a*, 20*b*, and 20*c*. In the first heat exchanger 10, the first path 10*a* is a downward path, the second path 10*b* is an upward path, and the third path 10*c* is a downward path. In the second heat exchanger 20, the first path 20*a* is an upward path, the second path 20*b* is a downward path, and the third path 20*c* is an upward path.

The number of tubes 30, i.e., the number of heat exchange passages 31 in the first path 10*a* of the first heat exchanger 10 is the smallest among those in the paths of the first and second heat exchangers 10 and 20. The number of tubes 30 in the second path 10*b* of the first heat exchanger 10 is equal to or greater than that in the third path 10*c* of the first heat exchanger 10. The number of tubes 30 in the first path 20*a* of the second heat exchanger 20 is smaller than that in the third path 10*c* of the first heat exchanger 10. The number of tubes 30 in the first, second, and third paths 20*a*, 20*b*, and 20*c* of the second heat exchanger 20 successively increase.

According to the first embodiment, the tubes 30 each have the same cross-sectional area. Accordingly, the cross-sectional area of a path is equal to the number of tubes in the path multiplied by the cross-sectional area of the tube. Namely, the evaporator 1 according to the first embodiment satisfies the following conditions:

$$S10a < S10b,\ S10c,\ S20a,\ S20b,\ S20c$$

$$S10b \geqq S10c > S20a$$

$$S20c \geqq S20b \geqq S20a$$

where S10*a* is the cross-sectional area of the first path 10*a* of the first heat exchanger 10, S10*b* is the cross-sectional area of the second path 10*b* of the first heat exchanger 10, S10*c* is the cross-sectional area of the third path 10*c* of the first heat exchanger 10, S20*a* is that of the first path 20*a* of the second heat exchanger 20, S20*b* is the cross-sectional area of the second path 20*b* of the second heat exchanger 20, and S20*c* is the cross-sectional area of the third path 20*c* of the second heat exchanger 20.

According to the first embodiment, the first heat exchanger 10 has three tubes in the first path 10*a*, fourteen tubes in the second path 10*b*, and thirteen tubes in the third path 10*c*. The second heat exchanger 20 has seven tubes in the first path 20*a*, nine tubes in the second path 20*b*, and fourteen tubes in the third path 20*c*.

Operation

With reference to FIGS. 7A and 7B, distribution of coolant introduced at a low flow rate into the evaporator 1 will be explained.

(i) The first path 10*a* (downward path) in the first heat exchanger 10 has the smallest number of tubes, and therefore, has the smallest cross-sectional area. Accordingly, liquid coolant in the first path 10*a* of the first heat exchanger 10 performs only limited little heat exchange and is passed to the second path 10*b* (upward path). The cross-sectional area S10*a* of the first path 10*a* in the first heat exchanger 10 is designed to be larger than the cross-sectional area of the coolant inlet 7, so that the first path 10*a* is not location so as to cause a maximum pressure loss in the evaporator 1.

(ii) Liquid coolant in the second path 10*b* (upward path) in the first heat exchanger 10 has a high density and fills the second path 10*b*. Therefore, the temperature distribution in the second path 10*b* will be uniform.

(iii) In the third path 10*c* (downward path) of the first heat exchanger 10, the liquid coolant has a lower density and higher flow rate. Accordingly, the liquid coolant flows down not only along a side (the left side in FIG. 7A) proximal to the second path 10*b* but also along a side (the right side in FIG. 7A) distal from the second path 10*b*. On the distal side from the second path 10*b*, a coolant loss L occurs as shown in FIG. 7A. The coolant loss L is relatively small because the third path 10*c* is narrower than the second path 10*b*. In a downward path, a large coolant loss L will occur if the coolant density is high and the coolant flow rate is low. The coolant loss L becomes smaller as the coolant density becomes lower and the coolant flow rate becomes faster.

(iv) The first path 20*a* (upward path) of the second heat exchanger 20 has a smaller number of tubes than the third path 10*c* of the first heat exchanger 10. Accordingly, the first path 20*a* of the second heat exchanger 20 substantially covers the coolant loss L in the first heat exchanger 10 and the coolant passes relatively uniformly therethrough. Namely, the first path 20*a* of the second heat exchanger 20 compensates for the coolant loss L of the first heat exchanger 10.

(v) In the second path 20*b* and third path 20*c* of the second heat exchanger 20, the coolant is substantially in a gaseous state, and therefore, produces a uniform temperature distribution.

As mentioned in (i) to (v), the evaporator 1 according to the first embodiment achieves a uniform temperature distribution (FIG. 7B) with the first and second heat exchangers 10 and 20 overlapping each other.

Effects of the evaporator 1 according to the first embodiment will be summarized.

(I) The first embodiment arranges the coolant inlet 7 at a first end (an upper left end in the drawing) of the evaporator 1 and the connection 9 for connecting the first and second heat exchangers 10 and 20 to each other at a second end (a lower right end in the drawing) of the evaporator 1. In the first heat exchanger 10, the first path 10*a* is a downward path, the second path 10*b* an upward path, and the third path 10*c* a downward path. In the second heat exchanger 20, the first path 20*a* is an upward path. The first path 10*a* of the first heat exchanger 10 has the smallest number of tubes among the paths 10*a* to 20*c*. The number of tubes in the second path 10*b* of the first heat exchanger 10 is equal to or greater than that in the third path 10*c* of the first heat exchanger 10. The number of tubes in the first path 20*a* of the second heat exchanger 20 is smaller than that in the third path 10*c* of the first heat exchanger 10. This configuration achieves the above-mentioned operations (i) to (v) to provide a uniform temperature distribution in the evaporator 1.

(II) The first embodiment increases the numbers of tubes in the paths of the second heat exchanger 20 from a downstream side toward an upstream side because the volume of coolant increases as heat exchange progresses in the second heat exchanger 20. This configuration suppresses coolant flow resistance.

(III) According to the first embodiment, the tubes in the heat exchangers 10 and 20 have an identical cross-sectional area. Accordingly, it is easy to manufacture the tubes.

(IV) The first embodiment arranges the coolant inlet 7 and coolant outlet 8 of the evaporator close to each other. Compared with arranging the inlet and outlet at locations separated away from each other, the configuration of the first embodiment is advantageous when connecting pipes (an inlet pipe 71 and a discharge pipe 72) to the inlet 7 and outlet 8. This is particularly advantageous when installing the evaporator in a limited space such as in a vehicle.

(V) According to the first embodiment, the cross-sectional area S10*a* of the first path 10*a* in the first heat exchanger 10 is greater than that of the coolant inlet 7. This configuration suppresses coolant flow resistance in the first path 10*a*.

(VI) The first embodiment provides three paths (10*a*, 10*b*, and 10*c*) in the first heat exchanger 10. Compared with a configuration involving two paths or one path (like the second and third embodiments), the first embodiment can reduce the cross-sectional areas S10*a*, S10*b*, and S10*c* of the paths. This configuration is effective to achieve a uniform temperature distribution in the first heat exchanger 10.

(VII) The first embodiment arranges the first heat exchanger 10 on a leeward side of the air flow and the second heat exchanger 20 on a windward side of the air flow. The second heat exchanger 20 on the windward side first cools air, and then, the first heat exchanger 10 that is colder than the second heat exchanger 20 further cools the cooled air. Namely, the second and first heat exchangers 20 and 10 cool air step by step. In this way, the first embodiment effectively uses the heat exchangers 20 and 10 on the windward and leeward sides to improve heat exchange efficacy.

The first embodiment may divide the second heat exchanger 20 into two or more paths instead of three paths.

Other embodiments of the present invention will be explained. In connection with the following embodiments, detailed drawings are omitted and the same or similar parts as those of the first embodiment are represented with the same reference identifiers to omit the explanations thereof. Each of the following embodiments omits the first path 10*a* of the first embodiment from the first heat exchanger 10. Namely, each of the following embodiments defines two paths in the first heat exchanger.

Second Embodiment

Figure 8A:
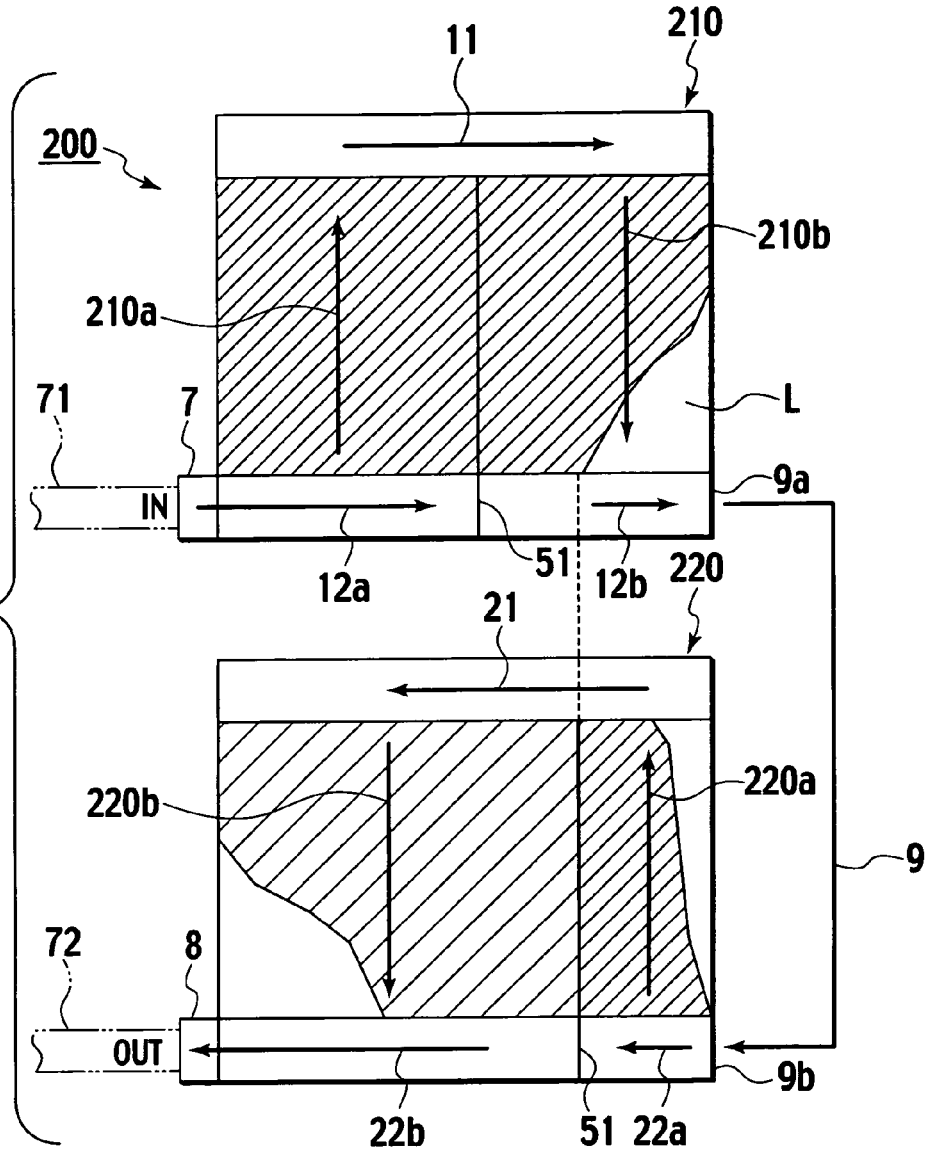
FIGS. 8A and 8B are views schematically showing an evaporator according to a second embodiment of the present invention.
Figure 8B:
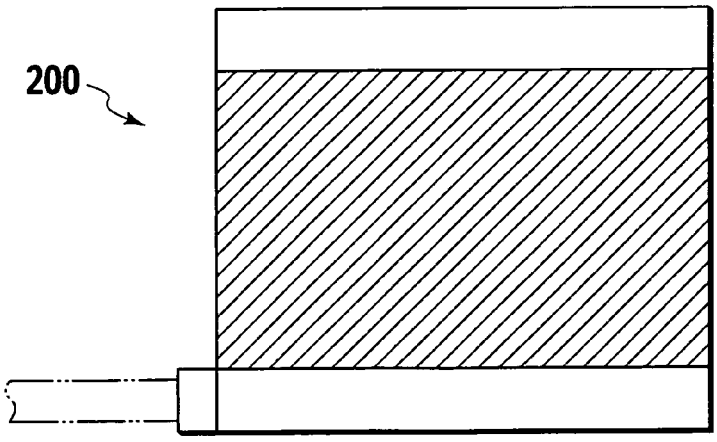

FIGS. 8A and 8B show an evaporator according to the second embodiment of the present invention.

Unlike the evaporator of the first embodiment, the evaporator 200 of the second embodiment forms a coolant inlet 7 and a coolant outlet 8 at a lower left end (as shown in the drawings) of the evaporator 200 and provides a first heat exchanger 210 with two paths and a second heat exchanger 220 with two paths. In the first heat exchanger 210, the first path 210*a* is an upward path and the second path 210*b* is a downward path. In the second heat exchanger 220, the first path 220*a* is an upward path. The number of tubes in the first path 210*a* of the first heat exchanger 210 is equal to or greater than that in the second path 210*b* of the first heat exchanger 210. The number of tubes in the first path 220*a* of the second heat exchanger 220 is smaller than that in the second path 210*b* of the first heat exchanger 210.

Namely, the second embodiment satisfies the following conditions:

$$S210a \geqq S210b > S220a$$

$$S220b \geqq S220a$$

where S210*a* is the cross-sectional area of the first path 210*a* of the first heat exchanger 210, S210*b* is the cross-sectional area of the second path 210*b* of the first heat exchanger 210, S220*a* is the cross-sectional area of the first path 220*a* of the second heat exchanger 220, and S220*b* is the cross-sectional area of the second path 220*b* of the second heat exchanger 220.

Operation

Operation of the second embodiment will be explained with reference to FIGS. 8A and 8B.

(xi) Liquid coolant in the first path 210*a* (upward path) of the first heat exchanger 210 has a high density and substantially fills the first path 210*a*, to achieve a uniform temperature distribution.

(xii) In the second path 210*b* (downward path) of the first heat exchanger 210, the liquid coolant has a lower density and higher flow rate. Accordingly, the liquid coolant flows down not only along a side (the left side in FIG. 8A) proximal to the first path 210*a* but also along a side (the right side in FIG. 8A) distal from the first path 210*a*. On the distal side from the first path 210*a*, a coolant loss L occurs as shown in FIG. 8A. The coolant loss L is relatively small because the second path 210*b* is designed to be narrower than the first path 210*a*.

(xiii) The first path 220*a* (upward path) of the second heat exchanger 220 has a smaller number of tubes than the second path 210*b* of the first heat exchanger 210. Accordingly, the coolant passes relatively uniformly through the first path 220*a* of the second heat exchanger 220. As shown in FIG. 8A, the first path 220*a* of the second heat exchanger 220 substantially covers the coolant loss L of the first heat exchanger 210. Namely, the first path 220*a* of the second heat exchanger 220 supplements the coolant loss L of the first heat exchanger 210.

(xiv) Coolant in the second path 220*b* of the second heat exchanger 220 is substantially gaseous, so as to achieve a uniform temperature distribution.

As mentioned in (xi) to (xiv), the evaporator 200 according to the second embodiment achieves a uniform temperature distribution (FIG. 8B) with the first and second heat exchangers 210 and 220 overlapping each other.

Effects of the evaporator 200 according to the second embodiment will be summarized.

(I) The second embodiment arranges the coolant inlet 7 at a first end (a lower left end) of the evaporator 200 and a connection 9 for connecting the first and second heat exchangers 210 and 220 to each other at a second end (a lower right end) of the evaporator. In the first heat exchanger 210, the first path 210*a* is an upward path and the second path 210*b* is a downward path. In the second heat exchanger 220, the first path 220*a* is an upward path. The number of tubes in the first path 210*a* of the first heat exchanger 210 is equal to or greater than that in the second path 210*b* of the first heat exchanger 210. The number of tubes in the first path 220*a* of the second heat exchanger 220 is smaller than that in the second path 210*b* of the first heat exchanger 210. This configuration achieves the above-mentioned operations (xi) to (xiv) and provides the same effect as the effect (I) of the first embodiment.

(II) Like the effect (II) of the first embodiment, the second embodiment increases the numbers of tubes in the paths from a downstream side toward an upstream side in the second heat exchanger 220 in which the volume of coolant increases as heat exchange progresses. This configuration suppresses a flow resistance of the coolant.

(III) Like the effect (III) of the first embodiment, the tubes in the heat exchangers 210 and 220 of the evaporator 200 according to the second embodiment have an identical cross-sectional area. Accordingly, the tubes are easy to manufacture.

(IV) Like the effect (IV) of the first embodiment, the second embodiment arranges the coolant inlet 7 and coolant outlet 8 of the evaporator 200 close to each other. Compared with arranging the inlet and outlet at locations separated away from each other, the configuration of the second embodiment is advantageous when connecting pipes (an inlet pipe 71 and a discharge pipe 72) to the inlet 7 and outlet 8. This is particularly advantageous when installing the evaporator in a limited space such as in a vehicle.

(V) Like the effect (V) of the first embodiment, the second embodiment designs the cross-sectional area of the first path 210*a* of the first heat exchanger 210 to be greater than the cross-sectional area of the coolant inlet 7. This configuration suppresses coolant flow resistance in the first path 210*a*.

(VII) Like the effect (VII) of the first embodiment, the second embodiment arranges the first heat exchanger 210 on the leeward side of the air flow and the second heat exchanger 220 on the windward side of the air flow. The second heat exchanger 220 on the windward side first cools air, and then, the first heat exchanger 210 that is colder than the second heat exchanger 220 further cools the cooled air. Namely, the second and first heat exchangers 220 and 210 cool air step by step. The second embodiment effectively uses the heat exchangers 220 and 210 on the windward and leeward sides to improve heat exchange efficacy.

Third Embodiment

Figure 9:
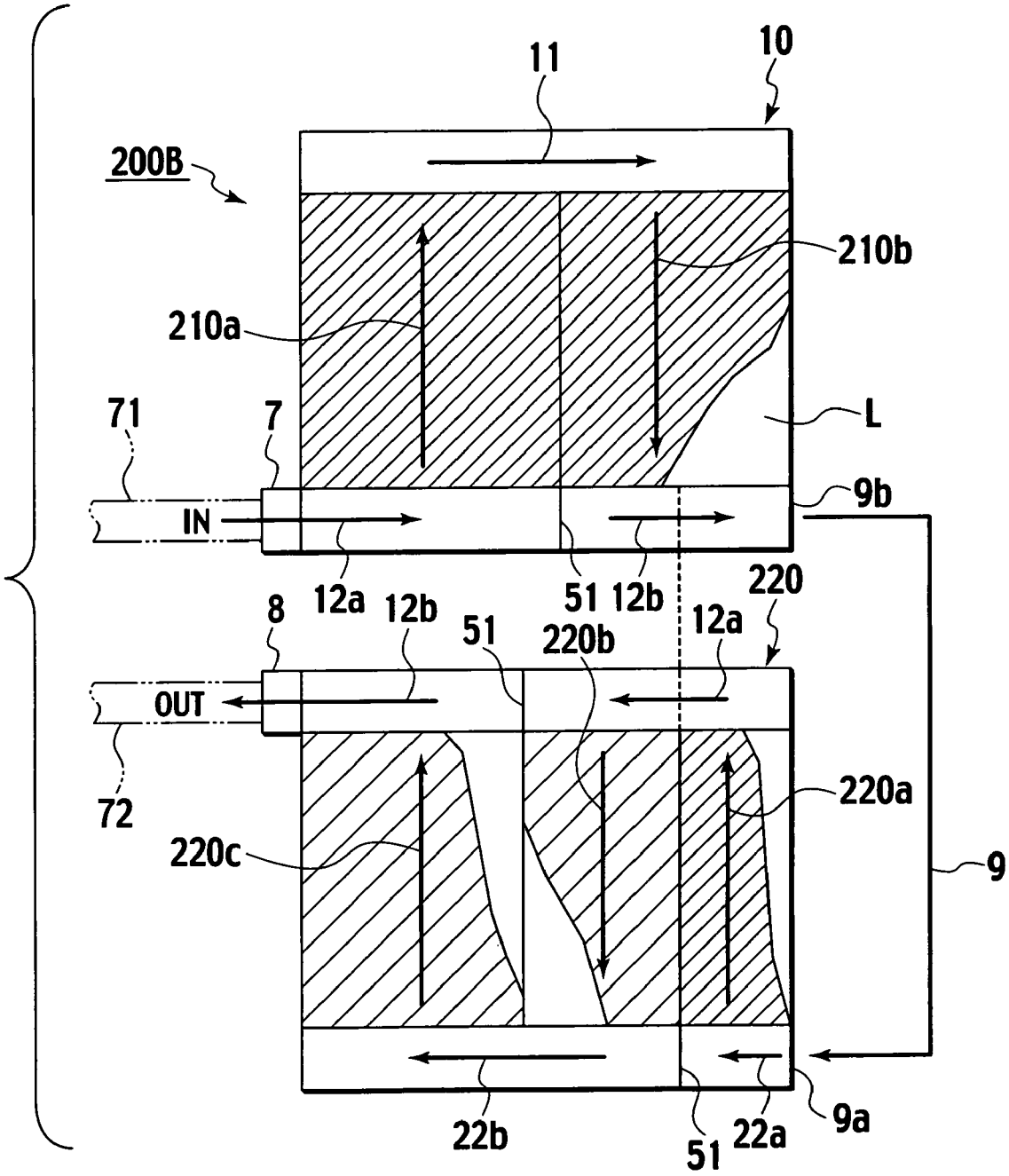
FIG. 9 is a view schematically showing an evaporator according to a third embodiment of the present invention.

FIG. 9 shows an evaporator according to the third embodiment of the present invention.

The evaporator 200B of the third embodiment employs a second heat exchanger 220 having three paths 220*a*, 220*b*, and 220*c*. A coolant outlet 8 is arranged at an upper left end (as shown in the drawing) of the evaporator 200B. The other arrangements of the third embodiment are substantially the same as those of the second embodiment. The third embodiment satisfies the following conditions:

$S210a \geqq S210b > S220a$ $S220c \geqq S220b \geqq S220a$

Accordingly, the third embodiment provides the same effects as the second embodiment except for the effect (IV) of the second embodiment.

Fourth Embodiment

Figure 10:
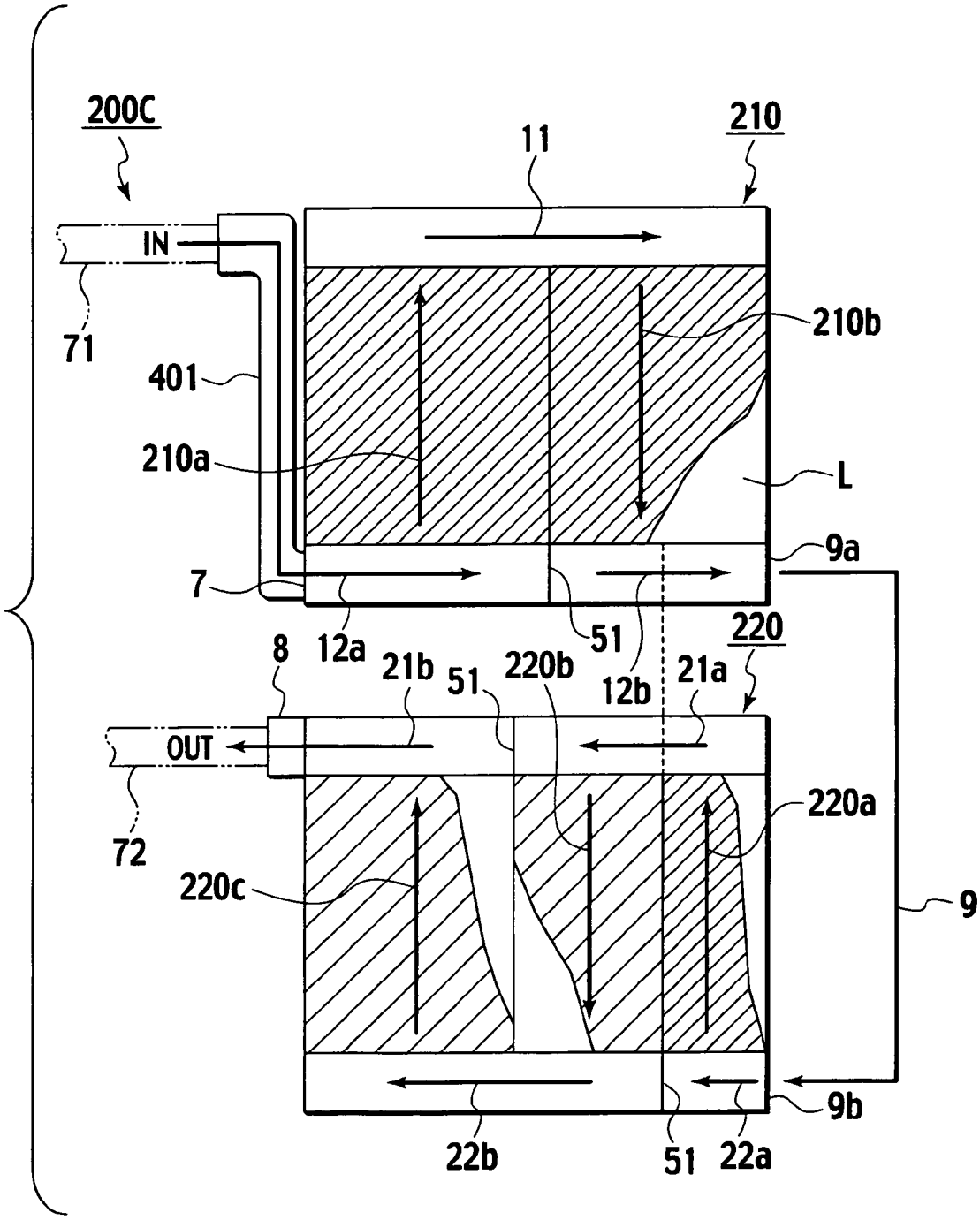
FIG. 10 is a view schematically showing an evaporator according to a fourth embodiment of the present invention.
Figure 11:
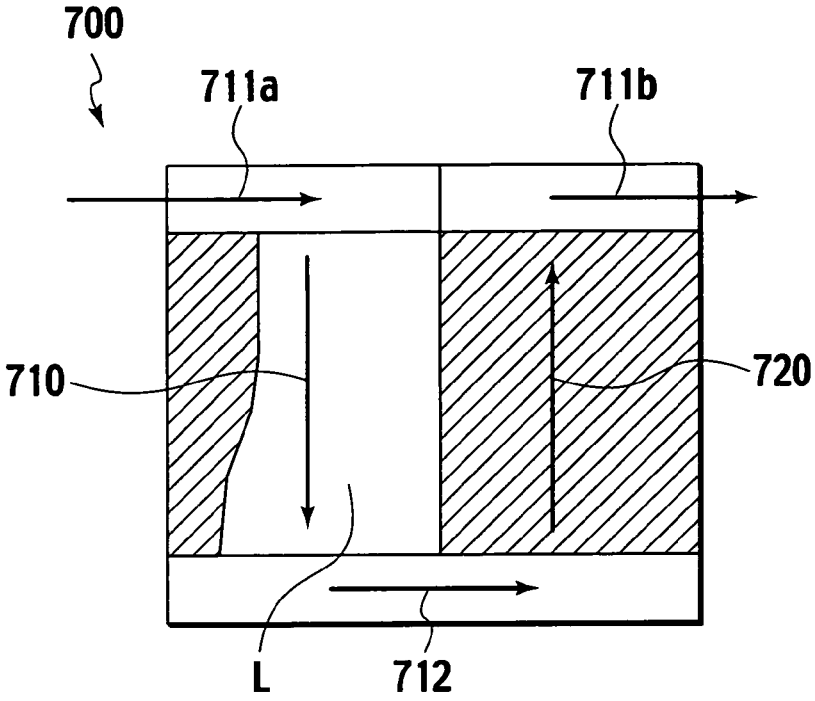
FIG. 11 is a view schematically showing distribution of a liquid coolant in a first heat exchanger of an evaporator according to a first comparative example.
Figure 12:
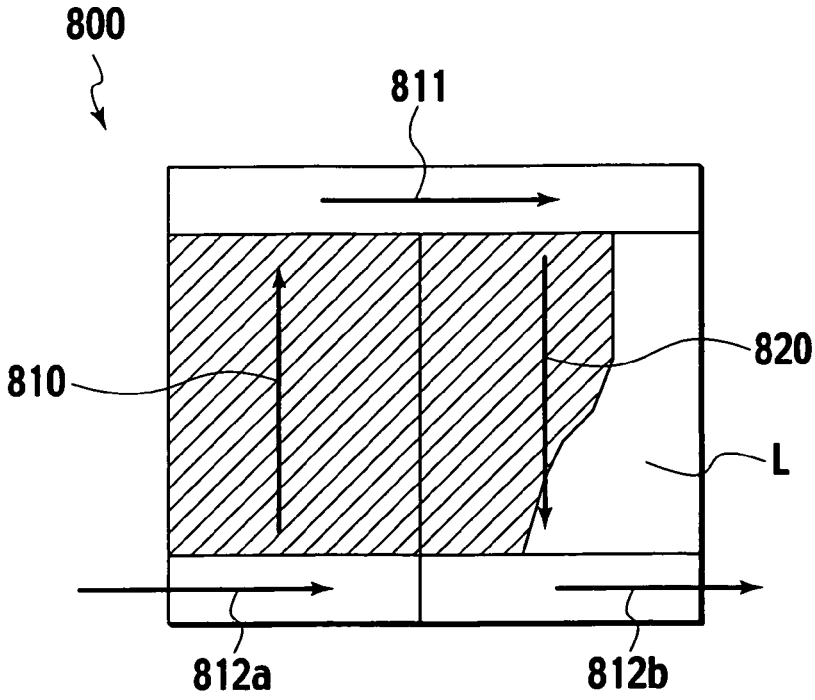
FIG. 12 is a view schematically showing distribution of a liquid coolant in a first heat exchanger of an evaporator according to a second comparative example.

FIG. 10 shows an evaporator according to the fourth embodiment of the present invention.

The evaporator 200C of the fourth embodiment employs a connector 401 that is connected to a coolant inlet 7 arranged at a lower left end (as shown in the drawing) of the evaporator 200C and extends close to a coolant outlet 8 arranged at an upper left end (as shown in the drawing) of the evaporator 200C. The other arrangements of the fourth embodiment are the same as those of the third embodiment. In addition to the effects of the third embodiment, the fourth embodiment provides an effect of making the piping installation easier because the connecting positions of an inlet pipe 71 and a discharge pipe 72 are close to each other.

The evaporator according to any one of the embodiments of the present invention is effective to achieve a uniform temperature distribution particularly when coolant is circulated at a low flow rate. For example, when an air-conditioning compressor is driven by an engine of a vehicle, the driving force allocated for driving the compressor is limited. In this case, coolant from the compressor tend to be circulated at a low flow rate through a refrigeration cycle. For such a case, the evaporator according to the present invention is particularly appropriate.

Although the present invention has been explained with reference to certain embodiments, the present invention is not limited to the embodiments. Modifications and variations of the embodiments can be made without departing from the spirit and scope of the appended claims. The embodiments, therefore, are only for illustrative purposes and are not intended to limit the present invention.

What is claimed is:

1. An evaporator comprising:

a first heat exchanger; and a second heat exchanger overlapping the first heat exchanger in an air passing direction, the first heat exchanger comprising:

an upper tank;

a lower tank;

tubes extending vertically and arranged side by side in a longitudinal direction of the upper and lower tanks, the tubes configured to connect the upper and lower tanks to each other and communicate with the upper and lower tanks;

a coolant inlet provided for the upper tank at a first end of the evaporator;

a coolant outlet provided for the lower tank at a second end of the evaporator; and partitions arranged inside the upper and lower tanks, the partitions configured to divide the inside of the first heat exchanger into a first path in which coolant that entered through the coolant inlet flows downwardly, a second path that is downstream from the first path and in which the coolant from the first path flows upwardly, and a third path that is downstream from the second path and in which the coolant from the second path flows downwardly, the second heat exchanger comprising:

an upper tank;

a lower tank;

tubes extending vertically and arranged side by side in a longitudinal direction of the upper and lower tanks, the tubes configured to connect the upper and lower tanks to each other and communicate with the upper and lower tanks;

a coolant inlet provided for the lower tank at the second end of the evaporator, the coolant inlet configured to introduce the coolant from the coolant outlet of the first heat exchanger into the second heat exchanger;

a coolant outlet arranged at the first end of the evaporator; and partitions arranged inside the lower tank, the partitions configured to divide the inside of the second heat exchanger into at least two paths including a first path in which the coolant that has entered through the coolant inlet flows upwardly, wherein the number of the tubes in the first path of the first heat exchanger being smaller than the number of the tubes in any one of the other paths of the first and second heat exchangers, the number of the tubes in the second path of the first heat exchanger being equal to or greater than the number of the tubes in the third path of the first heat exchanger, and the number of the tubes in the first path of the second heat exchanger being smaller than the number of the tubes in the third path of the first heat exchanger.

2. The evaporator of claim 1, wherein:

the number of the tubes in the paths in the second heat exchanger successively increase from the first path toward the last path.

3. The evaporator of claim 1, wherein:

the cross-sectional area of the first path in the first heat exchanger is equal to or greater than the cross-sectional area of the coolant inlet of the first heat exchanger.

4. The evaporator of claim 1, wherein:

the tubes in the heat exchangers each have the same cross-sectional area.

5. The evaporator of claim 1, wherein:

the coolant inlet of the first heat exchanger and the coolant outlet of the second heat exchanger are arranged adjacent to each other.

* * * * *